US011986080B2

(12) United States Patent
Li

(10) Patent No.: US 11,986,080 B2
(45) Date of Patent: May 21, 2024

(54) REPLACEABLE ALUMINUM ALLOY BOX FOR DEODORANT CREAM

(71) Applicant: SamBound New Material Technology packaging Limited, Guangdong (CN)

(72) Inventor: Binglu Li, Guangdong (CN)

(73) Assignee: SamBound New Material Technology packaging Limited, Guangdong (CN)

( * ) Notice: Subject to any disclaimer, the term of this patent is extended or adjusted under 35 U.S.C. 154(b) by 0 days.

(21) Appl. No.: 17/968,786

(22) Filed: Oct. 18, 2022

(65) Prior Publication Data

US 2024/0041184 A1 Feb. 8, 2024

(30) Foreign Application Priority Data

Aug. 8, 2022 (CN) ..... 202222075792.1

(51) Int. Cl.
*A45D 40/06* (2006.01)
*A45D 40/00* (2006.01)

(52) U.S. Cl.
CPC ..... *A45D 40/06* (2013.01); *A45D 2040/0031* (2013.01)

(58) Field of Classification Search
CPC ..... B65D 83/0011; A45D 2040/0031; A45D 2040/0043; A45D 2040/005; A45D 2040/0056; A45D 40/06; A45D 40/02; A45D 40/16; A45D 2200/055
See application file for complete search history.

(56) References Cited

U.S. PATENT DOCUMENTS 1,254,667 A * 1/1918 Fesler ..... B65D 83/0011 401/175
2,485,467 A * 10/1949 Weisbaum ..... B65D 83/0011 222/390
4,139,127 A * 2/1979 Gentile ..... B65D 83/0011 401/175
4,921,130 A * 5/1990 Hollberg ..... B65D 83/0011 222/536
2009/0321478 A1* 12/2009 Juteau ..... B65D 83/0011 220/288
2020/0054110 A1* 2/2020 Wiesenthal ..... A45D 40/16

FOREIGN PATENT DOCUMENTS

WO WO-2021055888 A1 * 3/2021 ..... A45D 40/04

* cited by examiner

*Primary Examiner* — David J Walczak
(74) *Attorney, Agent, or Firm* — JCIPRNET

(57) ABSTRACT

A replaceable aluminum alloy box for deodorant cream includes an upper cover, a middle case and a lower cover. The upper cover is threadedly connected with the middle case. The middle case is rotatably connected with the lower cover. The upper cover, the middle case and the lower cover form an accommodation cavity with a cup in the accommodation cavity. The lower cover is fixed with a nut. The nut is fixed with a threaded rod. The threaded rod is threadedly connected with an inner disk which is located in the cup. The threaded rod passes through a bottom of the cup. By rotating the lower cover, the cream is driven up and down by the inner disk.

9 Claims, 5 Drawing Sheets

REPLACEABLE ALUMINUM ALLOY BOX FOR DEODORANT CREAM

CROSS-REFERENCE TO RELATED APPLICATION

This application claims the priority benefit of China application serial no. 202222075792.1, filed on Aug. 8, 2022. The entirety of the above-mentioned patent application is hereby incorporated by reference herein and made a part of this specification.

BACKGROUND

Technical Field

The present invention relates to the technical field of cosmetics, and in particular to a replaceable aluminum alloy box for deodorant cream.

Description of Related Art

For existing deodorant cream boxes, most of them are made of plastic packaging materials. The plastic materials have poor heat resistances and cold resistances, are easy to age, have poor sealing performances, are prone to be charged with static electricity, have difficulties in disposal of waste, and cannot be reused. After the cream is used up, the deodorant cream box will be discarded as a whole, and a new one will be used, resulting in a waste of resources.

Therefore, based on the above-mentioned defects of the existing deodorant cream boxes, it is necessary to improve the existing deodorant cream boxes.

SUMMARY

In view of the deficiencies of the prior art, the purpose of the present invention is to provide a replaceable aluminum alloy box for deodorant cream. The replaceable aluminum alloy box for deodorant cream addresses the deficiencies of existing deodorant cream boxes, such as being unable to be reused.

In order to achieve the above purpose, the present invention is implemented by the following technical solution: a replaceable aluminum alloy box for deodorant cream, comprising an upper cover, a middle case and a lower cover, wherein the upper cover is threadedly connected with the middle case, the middle case is rotatably connected with the lower cover, the upper cover, the middle case and the lower cover form an accommodation cavity with a cup in the accommodation cavity, the lower cover is fixed with a nut, the nut is fixed with a threaded rod, the threaded rod is threadedly connected with an inner disk, the inner disk is located in the cup, and the threaded rod passes through a bottom of the cup.

Further, a lower end of the middle case has an inverted buckle, an inner wall of the lower cover has an annular protrusion, and the inverted buckle and the annular protrusion are buckled together, such that the lower cover and the middle case are connected stably and rotatably.

Further, a bottom surface of the cup has a perforating hole, and an upper end of the nut has a convex part embedded into the perforating hole of the cup, such that the cup will not rotate.

Further, the lower cover has a bottom hole, a lower part of the nut has a quadrilateral positioning part, and the positioning part has four positioning corners embedded in the bottom hole, such that the nut and the lower cover are fixed together.

Further, an inner bottom of the cup has a gasket, and a position where a convex part of the nut is in contact with a perforating hole of the cup is covered by the gasket, which increases the air tightness.

Further, the threaded rod has an upper section and a lower section, the upper section has threads to be connected with the inner disk, and the lower section has threads to be stably connected with the nut.

Further, a spacer ring is provided between the upper section and the lower section of the threaded rod, and the gasket is pressed by the spacer ring, thereby fixing the gasket.

Further, a bottom surface of the lower cover is concave to form a concave space for accommodating the positioning part of the nut.

Further, the threaded rod passes through a middle part of the inner disk, the middle part of the inner disk extends downward to form a downward extension sleeve, the downward extension sleeve has internal threads, and the downward extension sleeve is threadedly connected with the threaded rod to increase the stability of the inner disk.

Further, the cup has two arc-shaped sides, the arc-shaped sides are connected by plane connecting parts, the inner disk has two arc-shaped edges, the arc-shaped edges are connected by straight-line edges, and the straight-line edges are in contact with the plane connecting parts, such that the inner disk will not rotate.

The beneficial effects of the present invention are in that: by rotating the lower cover, the cream is driven up and down by the inner disk, and the cream can be replaced with a new one after being used up, thus realizing repeated use, resource-saving, a simple structure, and improved use experience of consumers.

DESCRIPTION OF THE EMBODIMENTS

The present invention will be further described below in conjunction with the drawings.

Figure 1:
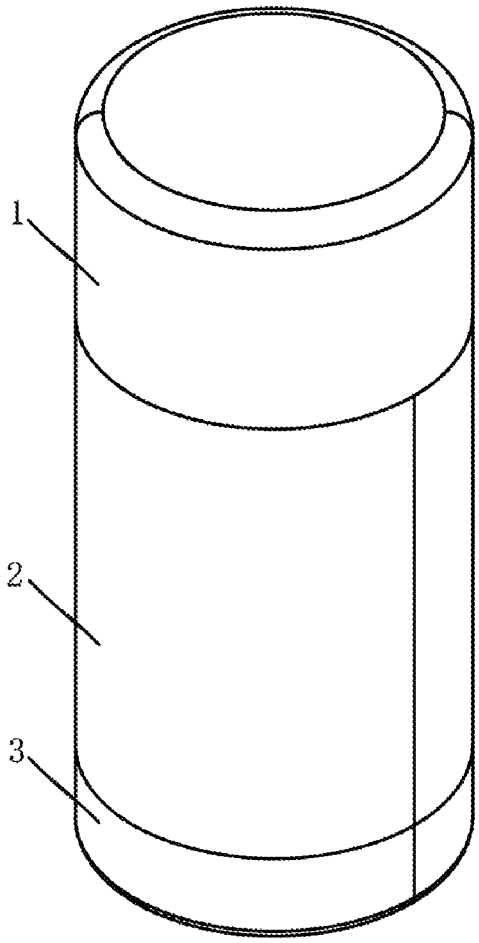
FIG. 1 is a schematic structural view of the present invention.
Figure 2:
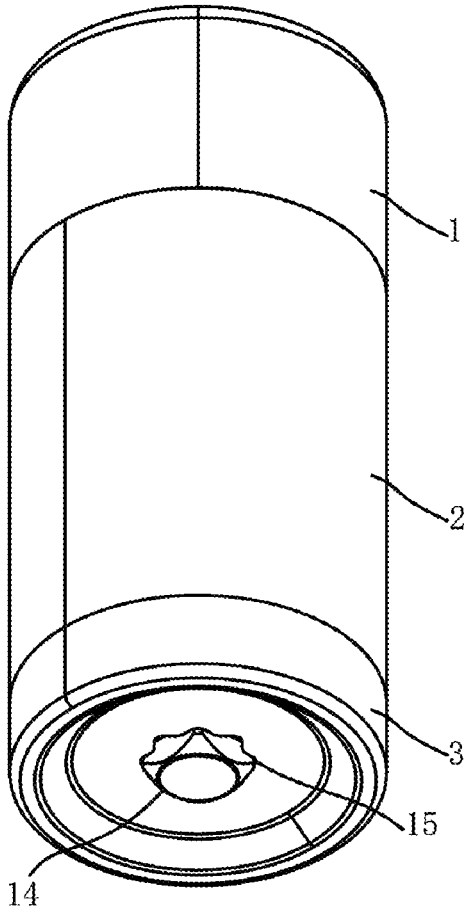
FIG. 2 is a schematic view of the present invention from another angle.
Figure 3:
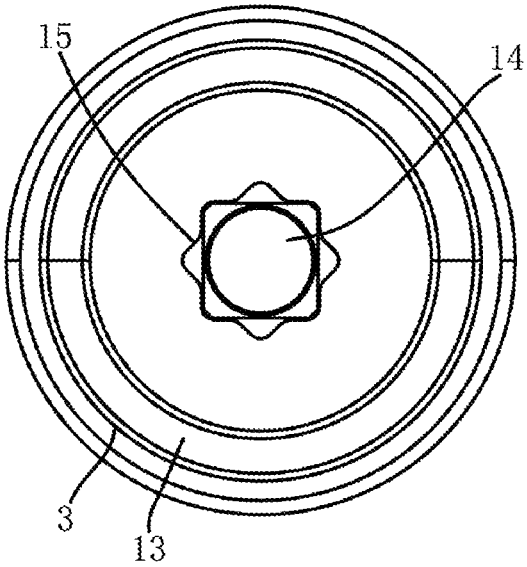
FIG. 3 is a bottom view of the present invention.
Figure 4:
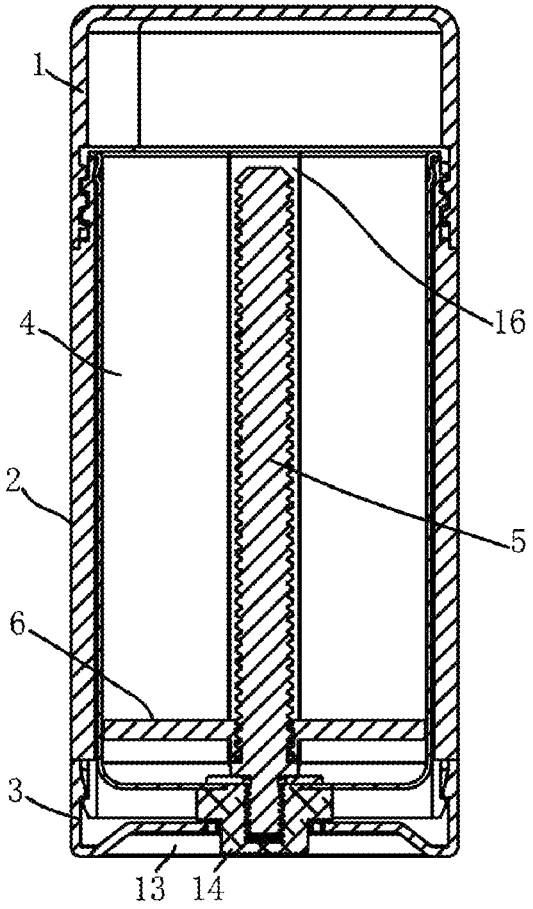
FIG. 4 is a schematic cross-sectional view of the present invention.
Figure 5:
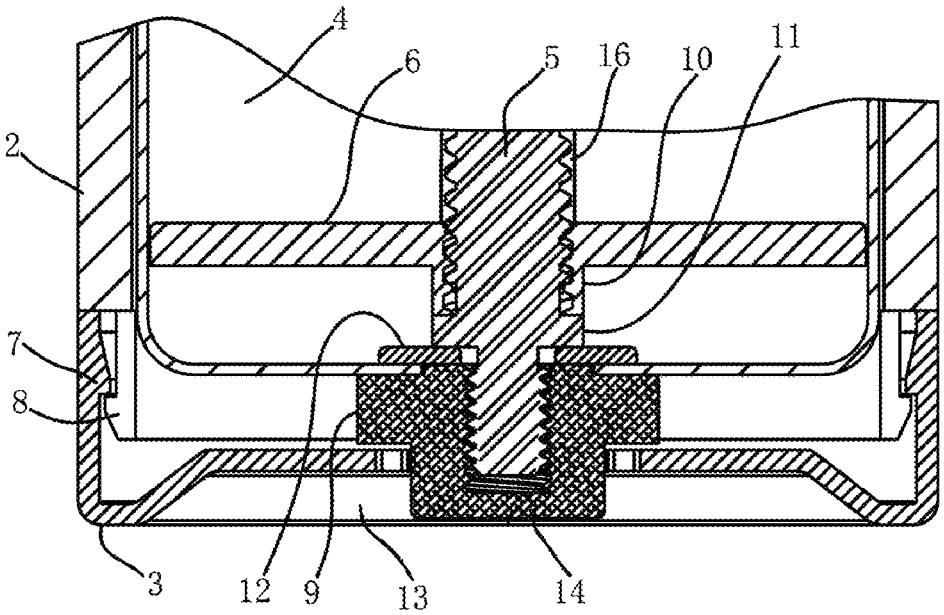
FIG. 5 is a schematic partially-enlarged view of FIG. 4.

Referring to FIG. 1 to FIG. 5, the replaceable aluminum alloy box for deodorant cream of the present invention includes: an upper cover 1, a middle case 2, and a lower cover 3. The upper cover 1 is threadedly connected with the middle case 2. The middle case 2 is rotatably connected with the lower cover 3. The upper cover 1, the middle case 2, and the lower cover 3 form an accommodation cavity with a cup 4 in the accommodation cavity. The lower cover 3 is fixed with a nut 9. The nut 9 is fixed with a threaded rod 5. The threaded rod 5 is threadedly connected with an inner disk 6, and the inner disk 6 is used for supporting the cream. A lower end of the middle case 2 has an inverted buckle 8, an inner wall of the lower cover 3 has an annular protrusion 7, and the inverted buckle 8 and the annular protrusion 7 are buckled together. A bottom surface of the cup 4 has a perforating hole, an upper end of the nut 9 has a protruding part, and the protruding part is embedded into the perforating hole of the cup 4.

The bottom hole 15 of the present invention is octagonal with eight corners. A lower part of the nut 9 has a quadrilateral positioning part 14, and the positioning part 14 has four positioning corners which are embedded in four corners of the bottom hole 15.

An inner bottom of the cup 4 of the present invention has a gasket 12. A position where the convex part of the nut 9 is in contact with the perforating hole of the cup 4 is covered by the gasket 12. The threaded rod 5 is provided with a spacer ring 11. The gasket 12 is pressed by the spacer ring 11. The gasket 12 can improve the air tightness.

The threaded rod 5 of the present invention has an upper section and a lower section. The upper section has threads to be connected with the inner disk 6. The inner disk 6 can move up and down along the threaded rod 5. The lower section has threads to be stably connected with the nut 9. The rotation of the lower cover 3 drives the nut 9 to rotate, and the threaded rod 5 is rotated together. Therefore, the inner disk 6 holds the cream up and down, which is convenient for people to use.

The spacer ring 11 of the threaded rod 5 of the present invention is located between the upper section and the lower section of the threaded rod 5.

A bottom surface of the lower cover 3 of the present invention is concave to form a concave space 13, which is used for accommodating the positioning part 14 of the nut 9.

The threaded rod 5 of the present invention passes through a middle part of the inner disk 6, the middle part of the inner disk 6 extends downward to form a downward extension sleeve 10, the downward extension sleeve 10 has internal threads, and the downward extension sleeve 10 is threadedly connected with the threaded rod 5, such that the up and down movement of the inner disk 6 is more stable.

The cup 4 of the present invention has two arc-shaped sides, and the arc-shaped sides are connected by plane connecting parts 16. Correspondingly, the inner disk 6 has two arc-shaped edges, and the arc-shaped edges are connected by straight-line edges. The straight-line edges are in contact with the plane connecting parts 16, which can ensure that the inner disk 6 will not rotate when the threaded rod 5 rotates.

In the present invention, the cream can be replaced after being used up. In addition, the cup 4, the threaded rod 5, the inner disk 6, the nut 9, and the gasket 12 form a replaceable core, which is placed in the accommodation cavity and can be disassembled and replaced with a new replaceable core after use, so as to realize repeated use and save resources. The upper cover 1, the middle case 2, the lower cover 3, and the cup 4 are made of aluminum alloy material. The aluminum alloy material can effectively isolate the air to prevent skin care products from being oxidized and affecting original functions of the skin care products, has high compressive strength, is not easy to be damaged, is not conducive to volatilization, and is convenient for storage, thus providing better protection for cosmetics.

The present invention has the characteristics of convenience, safety, and ease of use, and the deodorant cream is not easy to volatilize and the quality is guaranteed.

What is claimed is:

1. A replaceable aluminum alloy box for deodorant cream, comprising an upper cover, a middle case and a lower cover, wherein the upper cover is threadedly connected with the middle case, the middle case is rotatably connected with the lower cover, the upper cover, the middle case and the lower cover form an accommodation cavity with a cup in the accommodation cavity, the lower cover is fixed with a nut, the nut is fixed with a threaded rod, the threaded rod is threadedly connected with an inner disk, the inner disk is located in the cup, and the threaded rod passes through a bottom of the cup, wherein a bottom surface of the cup has a perforating hole, and an upper end of the nut has a convex part embedded into the perforating hole of the cup.

2. The replaceable aluminum alloy box for deodorant cream of claim 1, wherein a lower end of the middle case has an inverted buckle, an inner wall of the lower cover has an annular protrusion, and the inverted buckle and the annular protrusion are buckled together.

3. The replaceable aluminum alloy box for deodorant cream of claim 1, wherein the lower cover has a bottom hole, a lower part of the nut has a quadrilateral positioning part, and the positioning part has four positioning corners embedded in the bottom hole.

4. The replaceable aluminum alloy box for deodorant cream of claim 3, wherein a bottom surface of the lower cover is concave to form a concave space.

5. The replaceable aluminum alloy box for deodorant cream of claim 1, wherein an inner bottom of the cup has a gasket, and a position where the convex part of the nut is in contact with the perforating hole of the cup is covered by the gasket.

6. The replaceable aluminum alloy box for deodorant cream of claim 5, wherein the threaded rod has an upper section and a lower section, the upper section has threads to be connected with the inner disk, and the lower section has threads to be stably connected with the nut.

7. The replaceable aluminum alloy box for deodorant cream of claim 6, wherein a spacer ring is provided between the upper section and the lower section of the threaded rod, and the gasket is pressed by the spacer ring.

8. The replaceable aluminum alloy box for deodorant cream of claim 1, wherein the threaded rod passes through a middle part of the inner disk, the middle part of the inner disk extends downward to form a downward extension sleeve, the downward extension sleeve has internal threads, and the downward extension sleeve is threadedly connected with the threaded rod.

9. The replaceable aluminum alloy box for deodorant cream of claim 1, wherein the cup has two arc-shaped sides, the arc-shaped sides are connected by plane connecting parts, the inner disk has two arc-shaped edges, the arc-shaped edges are connected by straight-line edges, and the straight-line edges are in contact with the plane connecting parts.

* * * * *